US005927408A

United States Patent [19]

Dummer et al.

[11] Patent Number: 5,927,408

[45] Date of Patent: Jul. 27, 1999

[54] HEAD BRAKE RELEASE WITH MEMORY AND METHOD OF CONTROLLING A DRILL HEAD

[75] Inventors: Robert E. Dummer, New Berlin; Gregory P. Dantzman, Sussex, both of Wis.

[73] Assignee: Bucyrus International, Inc., South Milwaukee, Wis.

[21] Appl. No.: 08/861,446

[22] Filed: May 22, 1997

[51] Int. Cl.[6] ..... E21B 3/06

[52] U.S. Cl. ..... 175/27; 175/162; 173/193; 173/156; 173/1

[58] Field of Search ..... 175/27, 203, 122, 175/162, 24, 40; 173/193, 194, 156, 184, 81, 13, 1; 702/9

[56] References Cited

U.S. PATENT DOCUMENTS

| | | | |
|---|---|---|---|
| 3,690,387 | 9/1972 | Dixon | 173/43 |
| 4,187,546 | 2/1980 | Heffernan et al. | 364/565 |
| 4,793,421 | 12/1988 | Jasinski | 175/27 |

*Primary Examiner*—David J. Bagnell
*Assistant Examiner*—Zakiya Walker
*Attorney, Agent, or Firm*—Quarles & Brady

[57] ABSTRACT

A control is provided for a drill head that is mounted on a drill mast. Hydraulic motors raise and lower the drill head and a hydraulically releasable brake holds the drill head in position on the mast. The control has a hoist line that connects the hydraulic motors to a source of hydraulic fluid under pressure. A brake release line is connected to the brake and a brake release valve normally connects the brake release to a tank. The brake release valve is electrically actuated to connect the brake release line to a source of hydraulic fluid under pressure to release the brake. A programmable logic controller with a memory storage controls the actuation of the brake release valve. A pressure transducer is connected to the hoist line and to the controller for providing a signal to the controller representative of the hoist line pressure and this signal is storable in the memory. The controller will actuate the brake release valve only after the hoist line pressure sensed by the transducer is as great as the pressure stored in memory. The control also includes a brake switch connected to the controller and actuated to set and release the brake. A timer in the controller is turned on for a predetermined time when the brake switch is actuated to set the brake, and the timer prevents the controller from actuating the brake release valve until the timer is turned off. While the timer is on, the existing hoist line pressure signals are stored in the memory. The controller ignores the pressure stored in memory when the mast is at a near horizontal angle as sensed by a mast angle sensor.

7 Claims, 4 Drawing Sheets

HEAD BRAKE RELEASE WITH MEMORY AND METHOD OF CONTROLLING A DRILL HEAD

BACKGROUND OF THE INVENTION

This invention relates to controlling the release of the brake on a drill head, and particularly to a method and apparatus which ensures that the brake will not be released unless sufficient hydraulic pressure is present to hold the drill head from falling.

Blast hole drills typically include a drill head mounted on a drill mast. The drill head raises and lowers a drill string and also rotates the drill string. An example of a blast hole drill of this type is described in U.S. Pat. No. 4,793,421, issued Dec. 27, 1988, for "Programmed Automatic Drill Control".

The drill head may be powered with electric or hydraulic motors for the rotary drive. The drill head may be hoisted and pulled down by electric or hydraulic motors or by hydraulic cylinders. If hydraulic, the system may consist of an open or closed circuit. The present invention is adapted for hydraulic systems.

The drill head contains a brake that holds it in place on the drill mast. The brake may consist of spring loaded calipers which normally engage or set the brake. When the head brake is released, the weight of the head is supported on the column of hydraulic fluid in a hoist line leading to the drill head motor. With the brake set, after the blast hole drill is shut down, the possibility exists that there will be insufficient pressure in the hoist line to support the head once the brake is released.

BRIEF SUMMARY OF THE INVENTION

It is a principal object of the invention to provide a method and apparatus for ensuring that the necessary hoist line pressure will be present upon start up so that the head brake can be released without uncontrolled falling of the drill head. This is accomplished by sensing the hoist line pressure necessary to support the weight of the head before the brake was set or the system turned off. The sensed pressure is recorded in the memory of a programmable logic controller. Upon the system being restarted, the controller compares the actual pressure then in the hoist line with the pressure stored in memory. The controller will prevent the release of the brake until the actual pressure in the hoist line is as great as that in memory. The controller will cause the pressure in the hoist line to rise to the necessary level.

A further object of the invention is to provide such a method and apparatus which is not activated when the mast of the blast hole drill has been placed in a horizontal position for travel from one site to another.

In accordance with the invention, a control is provided for a drill head mounted on a drill mast that includes a hydraulic motor to raise and lower the drill head and a hydraulically releasable brake that holds the drill head in position on the mast. The control includes a hoist line connecting the hydraulic motor to a source of hydraulic fluid under pressure, a brake release line connected to the brake, a brake release valve nonnally connecting the brake release line to tank and electrically actuated to connect the brake release line to a source of hydraulic fluid under pressure to release the brake, a programmable logic controller with a memory storage for controlling the actuation of the brake release valve, and a pressure transducer connected to the hoist line and the controller for providing a signal to the controller representative of the hoist line pressure which is storable in the memory. The controller will actuate the brake release valve only after the hoist line pressure sensed by the transducer is as great as the pressure stored in memory.

Preferably, the control includes a brake switch connected to the controller and actuated to set and release the brake. A timer in the controller is turned on for a predetermined time when the brake switch is actuated to set the brake. The timer prevents the controller from actuating the brake release valve to set the brake until the timer is turned off. While the timer is on, the existing hoist line pressure signals are stored in the memory.

Further in accordance with the invention, a mast angle sensor is connected to the controller to provide a signal thereto of the angle of the mast. The controller ignores the pressure stored in memory when the mast is at a near horizontal angle.

The invention also resides in a method of controlling a drill head mounted on a drill mast that includes a hydraulic motor to raise and lower the head and a releasable brake that holds the brake in position on the mast. The method includes the steps of monitoring the pressure in a hoist line that connects the motor to a source of hydraulic fluid under pressure, storing the hoist line pressure in a memory before the brake is set, comparing the pressure in the hoist line with that stored in memory when the brake is to be released, and releasing the brake only if the hoist line pressure is as great as that stored in memory.

The foregoing and other objects and advantages of the invention will appear in the detailed description which follows. In the description, reference is made to the accompanying drawings which illustrate a preferred embodiment of the invention.

DETAILED DESCRIPTION OF THE PREFERRED EMBODIMENT

Figure 1:
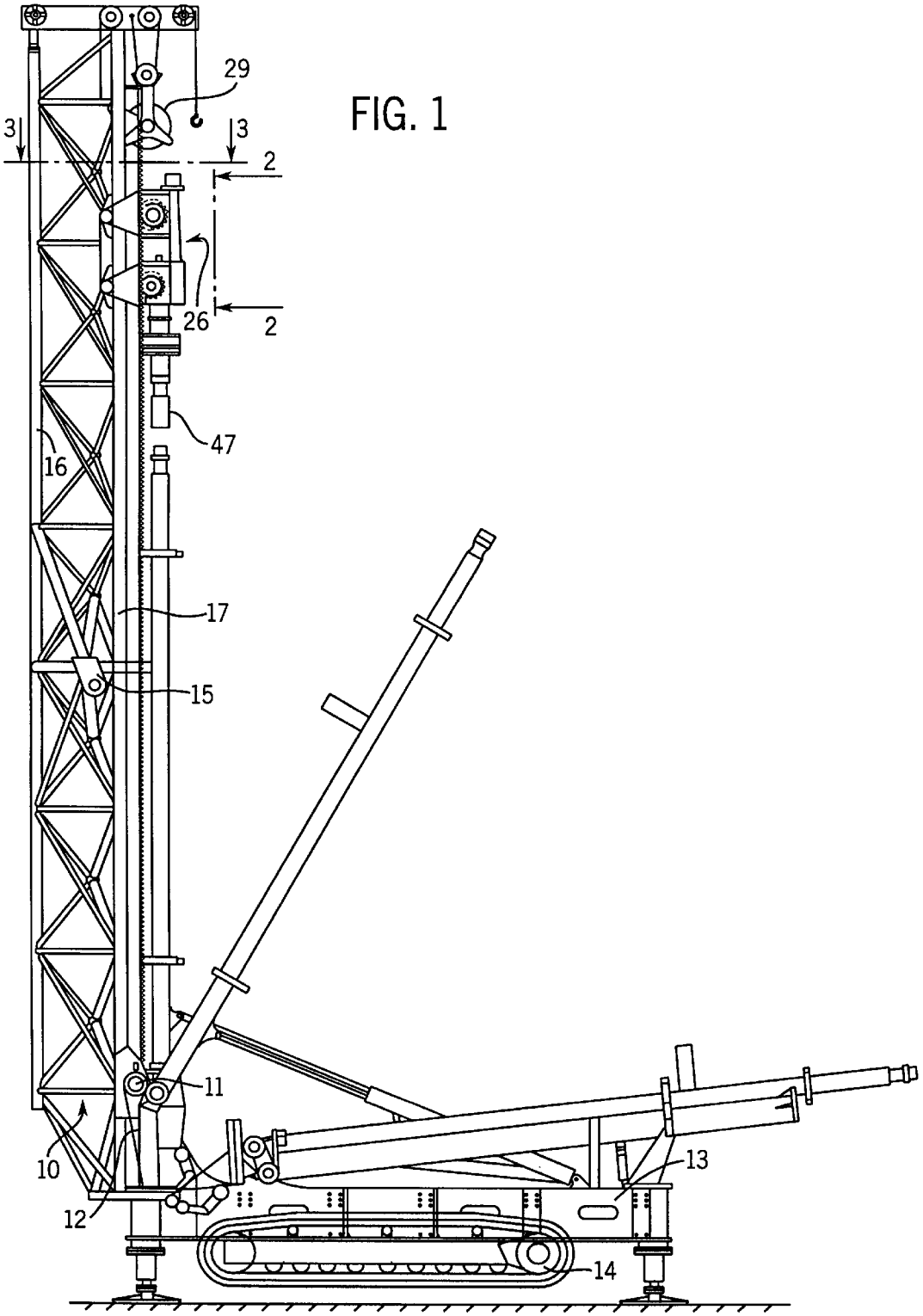
FIG. 1 is a view in elevation of a mobile blast hole drill unit with which the present invention may be used.
Figure 2:
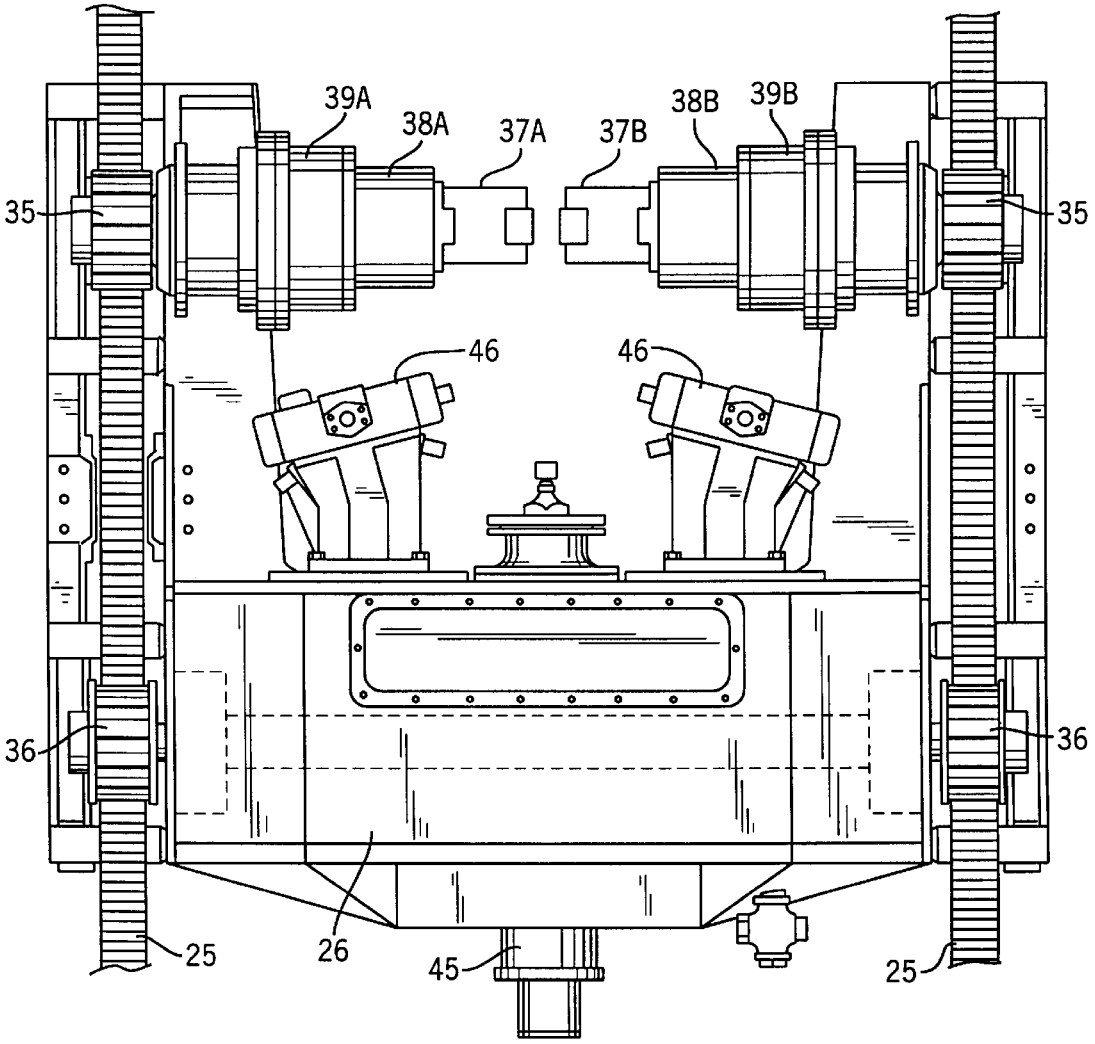
FIG. 2 is a view in elevation of the drill head of the blast hole drill unit of FIG. 1 viewed in the plane of the line 2—2 of FIG. 1.
Figure 3:
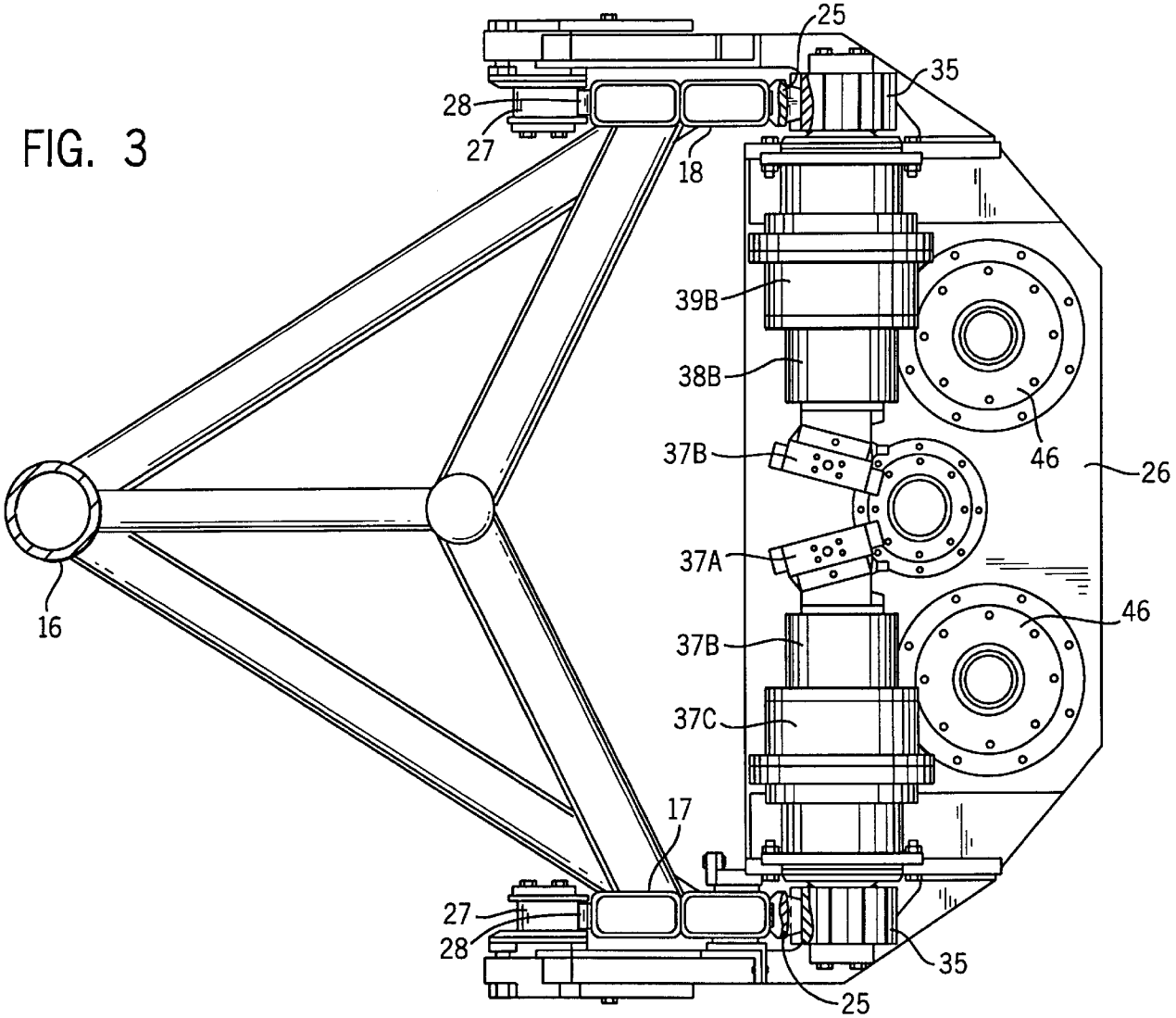
FIG. 3 is a top view of the drill head of FIG. 2 and viewed in the plane of the line 3—3 of FIG. 1.

The invention is shown incorporated into a blast hole drill having a tubular drill mast that is described in pending U.S. Provisional Patent Application No. 60/020,856 filed Jun. 28, 1996 for "Tubular Drill Mast". The disclosure of that provisional application is hereby incorporated by reference as though fully set forth herein. Briefly, the mast 10 is mounted on pivot pins 11 held in a standard 12 which rises from the main deck 13 of a crawler tractor 14. The mast 10 is adapted to be raised and lowered by a hydraulic cylinder (not shown) connected between the deck 13 and lugs 15 on either side of the mast 10. The mast 10 is formed with three longitudinal chords; a central chord 16 and side chords 17 and 18. The side chords 17 and 18 are each formed of two rectangular steel tubes welded together along their length.

One edge of each of the side chords 17 and 18 mounts gear tooth racks 25. The racks 25 are engaged by gears on a hoist/pulldown mechanism 26. The hoist/pulldown mechanism 26 includes rollers 27 which ride along a track 28 at the rear of each of the side chords 17 and 18 on the side opposite to the racks 25. A hydraulic hose carrier assembly 29 also travels along the length of the side chords 17 and 18.

The racks 25 are engaged by upper drive pinions 35 and lower idler pinions 36. The upper and lower pinions 35 and 36 are at the same levels as the guide rollers 27. The upper drive pinions 35 are each driven by a hydraulic hoist motor 37A or B which is connected to a brake 38A or B which in turn is connected to a gear box 39A or B for driving the pinion 35. The hoist/pulldown mechanism 26 mounts a rotary drill head 45 which is driven by hydraulic motors 46. The purpose of the hoist/pulldown mechanism 26 is to hoist and pulldown the drill head 45 which rotates the drill string 47. The drill string is rotated for attaching and releasing lengths of pipe which form the drill string and for drilling and withdrawal operations, all in a known manner.

The crawler tractor 14 is typically also driven by hydraulic motors in a closed circuit hydrostatic drive.

Figure 4:
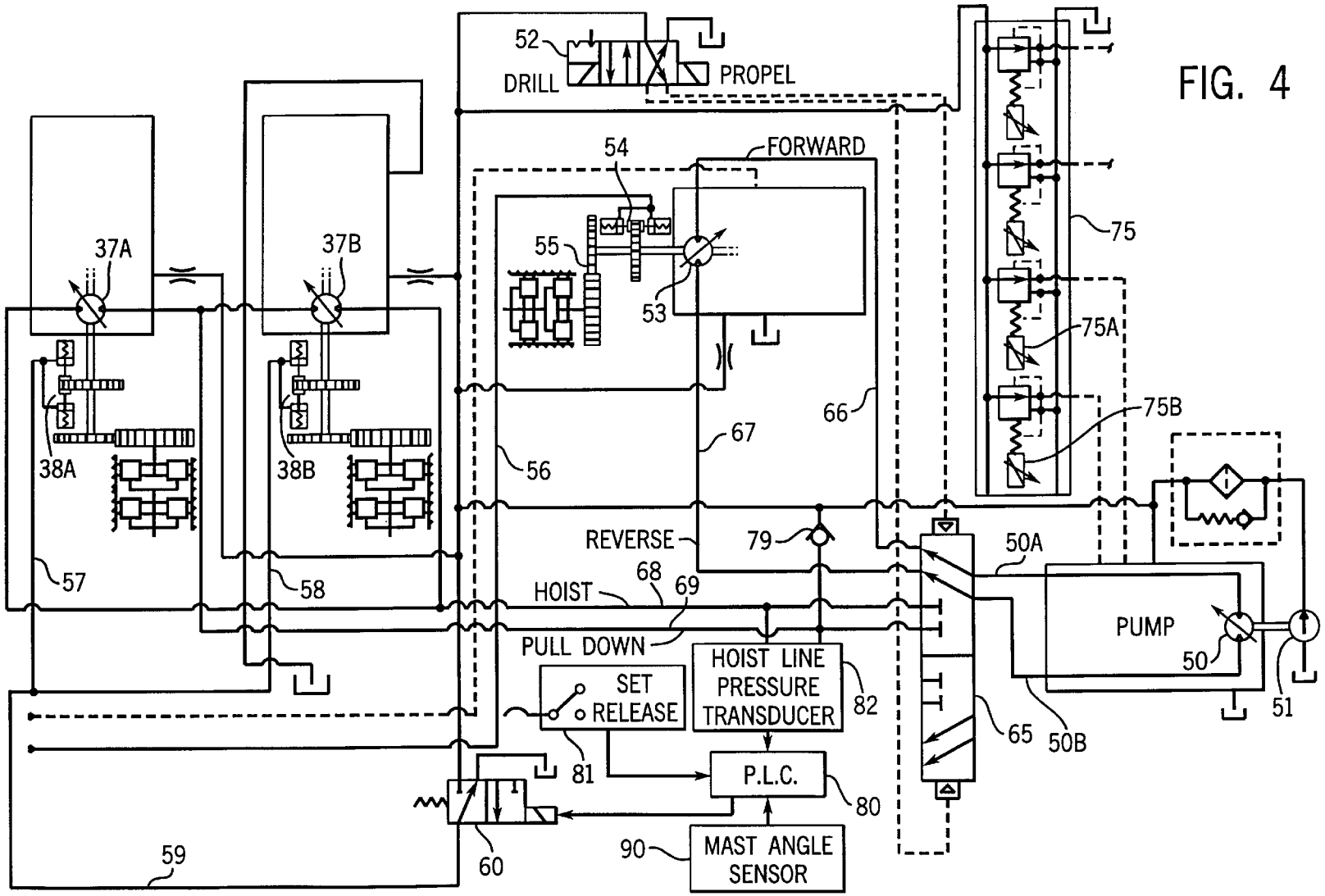
FIG. 4 is a schematic diagram of a portion of the hydraulic system for the blast hole drill unit and illustrating the system of the present invention.

FIG. 4 shows a portion of the hydrostatic drive for the propel functions of the tractor 14 and the hoist and pulldown functions for the hoist/pulldown mechanism 26. A main pump 50 provides the hydraulic fluid under pressure for the operation of the hydraulic system of FIG. 4. A pilot pump 51 provides hydraulic fluid under pressure for control functions. A solenoid operated valve 52 selects whether the main pump 50 is connected to the motor 53 which propels the tractor 14 in forward or reverse directions, or whether the main pump 50 is connected to the left and right hoist motors 37A and 37B.

As shown in FIG. 4, the propel motor 53 operates through a caliper brake 54 and a gear box 55 to drive the crawler mechanisms. The caliper brake 54 is spring loaded for engagement and is released by hydraulic pressure through a line 56. The head brakes 38A and 38B connected to the hoist motors 37A and 37B, respectively, are also caliper brakes which are spring loaded for engagement and are released by hydraulic pressure in lines 57 and 58, respectively, connected to a hoist brake release line 59. The hoist brake release line 59 leads to a hoist brake release valve 60 that is solenoid actuated.

The select valve 52 will pilot a valve 65 to alternately connect the ports 50A and 50B of the main pump 50 to the forward line 66 and reverse line 67 which connect to the propel motor 53 and determine the direction in which that motor will be driven. Alternatively, the ports 50A and 50B of the main pump 50 are connected by the piloted valve 65 to the hoist line 68 and pulldown line 69, respectively, which lead to the hoist motors 37A and 37B to drive those motors in the appropriate direction for raising or lowering the drill head. An electrohydraulic proportional control valve 75 controls the output of the main pump 50. If the coils 75A and 75B of the valve 75 are de-energized, the main pump 50 is at neutral.

When both the main pump 50 and the pilot pump 51 are driven, and when the select valve 52 has been energized so that the piloted valve 65 is switched from its position shown in FIG. 4 to a position in which the output of the main pump 50 is connected to the hoist and pulldown lines 68 and 69, and the brake release valve 60 has been energized, the brakes 38A and 38B will be released and the weight of the hoist/pulldown mechanism 26 will be supported on the column of oil inside the hoist line 68. However, if the coils 75A and 75B of the valve 75 have not been energized so that the main pump 50 will be at neutral, the hanging load will cause the hoist motors 37A and 37B to act as pumps. The hoist motors will discharge oil into the hoist line 68 in an effort to raise sufficient pressure to support the weight of the hanging load. Since the motors 37A and 37B are in a closed circuit hydrostatic drive, sufficient oil must be supplied to their inlet ports from the pulldown line 69 to ensure that they can stay full of oil and not cavitate while they are discharging or trying to discharge into the hoist line 68. To prevent this possibility, the pilot pump 51 is connected through a check valve 79 to the pulldown line 69.

Pilot pump 51 connects, in a known manner, to supercharge check valves inside of main pump 50 in such a way that ports 50A and 50B will be pressurized to 400 psi when the main pump 50 is at neutral. When valve 65 is in the position shown in FIG. 4, the ports 50A and 50B communicate with forward line 66 and reverse line 67, respectively. Without the check valve 79, the hoist line 68 and pulldown line 69 could drain to, or nearly to, tank pressure. Once the "drill" coil of select valve 52 is energized to shift the piloted valve 65 to its alternate position, it would take 20 or more seconds for the pulldown line to see 400 psi at the hoist motors 37A and 37B. If within that period of 20 seconds or more, the brake release valve 60 were to be energized to release the brakes 38A and 38B, the motors 37A and 37B would cavitate and run away. By providing the check valve 79, a charge pressure of 400 psi will always be available to the pulldown line 69 regardless of the position to which the piloted valve 65 is shifted or how long the valve 65 has been shifted before the brake release valve 60 is energized.

The present invention employs a programmable logic controller 80 which includes a storage memory and a timer circuit. A suitable controller 80 is a model SLC 500 available from Allen-Bradley Company with a SLC 5/03 microprocessor and a memory card.

A hoist brake control switch 81 is connected to the controller 80. The switch 81 can be positioned by the machine operator. The brake control switch 81 controls the energization of the brake release valve 60, which in turn controls whether the brakes 38A and 38B are released or set. The signal from the switch 81 passes through the controller 80. The controller 80 can block the signal or let it pass to the release valve 60 to energize the same, depending upon the comparative difference between a pressure stored in memory and the actual pressure in the hoist line 68 when the switch 81 is set to release the brakes.

To set the hoist brakes, the controller 80 must de-energize the solenoid of the hoist brake release valve 60 so that the pressure within the hoist brake release line 59 will be connected to tank and the brakes 38A and 38B will be set under spring pressure. When the switch 81 is moved to set the brakes, a timer circuit in the controller 80 is turned on and will stay on for a predetermined amount of time. The hoist brake release valve 60 will not be de-energized by the controller 80 until the timer is turned off. While the timer is running, a hoist line pressure transducer 82 connected to the hoist line 68 will feed information to the controller memory circuit concerning the hoist line pressure at the instant when the switch 81 is moved from release to set the brake. The hoist line pressure that was necessary to support the load is thus stored in memory.

When the brakes are set, the drill head 45 is mechanically locked in place so that it cannot drift. However, when the machine is shut down, inherent leakage in the main pump 50, the hoist motors 37A and 37B, and the piloted valve 65 will allow the pressure that was present in the hoist line 68 to support the head 45 to drop off to atmospheric pressure. When the machine is restarted, the greatest pressure that can be expected in the hoist line 68 is 400 psi, as explained above. This could be thousands of psi less than what has been stored in memory. Therefore, when the machine is restarted with the main pump 50 in neutral and the valve 65 set for hoist and pulldown, if the operator shifts the brake control switch 81 to release the brakes, the following actions will occur before the release valve 60 is allowed to be energized:

(1) The controller 80 will compare the actual pressure that is currently in the hoist line 68 with the pressure stored in its memory circuit.

(2) If the actual pressure in the hoist line 68 is equal to or greater than what is in memory, the valve 60 will be energized immediately allowing the head brakes 38A and 38B to release.

(3) If the actual pressure in the hoist line 68 is less than that in the memory of the controller, coil 75A of valve 75 will be energized to cause the main pump 50 to send sufficient oil into the hoist line 68 until the actual pressure in the hoist line is equal to the pressure in the controller memory.

(4) As soon as the actual pressure in the hoist line 68 is equal to the pressure in the controller memory, coil 75A of valve 75 is de-energized and a timer circuit in the controller 80 will turn on and run for a predetermined time to allow the main pump 50 to return to neutral to keep pressure overshoot to an acceptable level.

(5) After the timing in the controller has been completed, the hoist brake release valve 60 will be energized to immediately release the head brakes 38A and 38B.

Drilling operations are typically conducted with the mast either vertical or within 30 degrees of vertical. It often happens that the head brakes are set while the mast is in or near a vertical attitude but the mast is thereafter lowered for servicing or for transport to another site. In that situation, it is important to disregard the hoist line pressure stored in memory when the brake is released with the mast in a horizontal attitude because it would be undesirable to drive the main pump 50 in that condition. The position of the mast is determined by an angle sensor 90 attached to the mast. The sensor 90 feeds a signal to the controller 80. When the signal indicates that the mast is below a predetermined angle, positioning of the brake switch 81 from set to release will cause the hoist brake release valve 60 to be energized immediately and thereby immediately release the head brakes 38A and 38B. Even though the stored pressure is ignored when the brake is released with the mast below a certain angle, the pressure stored in memory is still available to use, such as when the head brakes are once again set with the mast below the predetermined control angle and the mast is again raised through the control angle to where it had been prior to lowering. The last stored pressure in memory while the mast was at or near vertical will again control when the head brake is thereafter released.

In FIG. 4, the pumps 50 and 51 and motors 37A, 37B, and 53 are shown in schematic form for purpose of illustration omitting valving that is well known in the art.

Although the invention has been described in relation to a hydrostatic drive that alternately powers the propel and hoist functions, it can be used with a hoist drive that is not associated with a propel drive. Furthermore, although the invention finds particular applicability to a closed circuit hydrostatic drive, the invention can also be applied to an open circuit system.

We claim:

1. A control for a drill head mounted on a drill mast that includes a hydraulic motor to raise and lower the drill head and a hydraulically releasable brake that holds the drill head in position on the mast, the control comprising:

a hoist line connecting the hydraulic motor to a source of hydraulic fluid under pressure;

a brake release line connected to the brake;

a brake release valve normally connecting the brake release line to a tank and electrically actuated to connect the brake release line to a source of hydraulic fluid under pressure to release the brake;

a programmable logic controller for controlling the actuation of the brake release valve, the controller including a memory storage; and a pressure transducer connected to the hoist line and the controller, the transducer being responsive to the pressure in the hoist line for providing a signal to the controller representative of the hoist line pressure which is storable in the memory, said controller actuating the brake release valve only after the hoist line pressure sensed by the transducer is as great as a pressure stored in memory.

2. A control in accordance with claim 1 together with a brake switch connected to the controller actuated to set and release the brake, and a timer in the controller which is turned on for a predetermined time when the brake switch is actuated to set the brake, the timer preventing the controller from actuating the brake release valve to set the brake until the timer is turned off, the pressure signal being stored in the memory while the timer is on.

3. A control in accordance with claim 1 together with a mast angle sensor connected to the controller to provide a signal thereto of the angle of the mast, the controller ignoring the pressure stored in memory when the mast is at a near horizontal angle.

4. A method of controlling a drill head mounted on a drill mast that includes a hydraulic motor to raise and lower the head and a releasable brake that holds the drill head in position on the mast, comprising the steps of:

monitoring the pressure in a hoist line that connects the motor to a source of hydraulic fluid under pressure;

storing in a memory the hoist line pressure that exists before the brake is set;

comparing the pressure in the hoist line with that stored in memory when the brake is to be released; and releasing the brake only if the hoist line pressure is as great as that stored in memory.

5. A method in accordance with claim 4 together with the steps of monitoring the angle of the mast, and ignoring the pressure stored in memory when the mast is at or near horizontal.

6. A method in accordance with claim 4 together with the step of increasing the pressure in the hoist line until it at least equals that stored in memory.

7. A control for a hydraulic drill head drive mounted on a drill mast that includes a hydraulic motor driven by a hydraulic drive pump to raise and lower the drill head and hydraulically releasable brakes that hold the drill head in position on the mast, the control comprising:

a hoist line connecting the drive pump to the hydraulic motor;

a pilot pump;

a brake release line connected to the hydraulic brake;

a brake release valve alternately connecting the brake release line to the pilot pump and to a tank;

a programmable logic controller having a memory; and a pressure transducer connected to the hoist line and to the controller to transmit a hoist line pressure signal to the memory;

said controller preventing the connection of the brake release line to the pilot pump until the pressure in the hoist line is as great as the pressure stored in memory.

* * * * *